US006758341B1

(12) United States Patent
Johnston

(10) Patent No.: US 6,758,341 B1
(45) Date of Patent: Jul. 6, 2004

(54) SEED ENVELOPE AND METHOD OF PACKAGING SEED

(75) Inventor: Robert H. Johnston, Columbus, OH (US)

(73) Assignee: Livingston Seed, Inc., Columbus, OH (US)

( * ) Notice: Subject to any disclaimer, the term of this patent is extended or adjusted under 35 U.S.C. 154(b) by 242 days.

(21) Appl. No.: 08/992,878

(22) Filed: Dec. 17, 1997

(51) Int. Cl.[7] ..... B65D 25/54
(52) U.S. Cl. ..... 206/778; 229/75
(58) Field of Search ..... 206/776, 777, 206/778; 229/68.1, 71, 75, 80, 162

(56) References Cited

U.S. PATENT DOCUMENTS

| | | | | | |
|---|---|---|---|---|---|
| 917,369 | A | * | 4/1909 | Skinner | 229/68.1 |
| D47,228 | S | | 4/1915 | Hirschfeld | |
| 1,150,524 | A | * | 8/1915 | Krone | 229/71 |
| 1,302,885 | A | * | 5/1919 | Vierengel | 229/71 |
| 1,598,396 | A | * | 8/1926 | Scandore | 206/772 |
| 1,799,428 | A | * | 4/1931 | Lewis | 229/71 |
| D87,489 | S | | 8/1932 | Rynveld | |
| 1,962,921 | A | * | 6/1934 | Tullar | 229/71 |
| D94,588 | S | | 2/1935 | Williams | |
| 2,114,367 | A | * | 4/1938 | Berkowitz | 229/68.1 |
| D123,512 | S | | 11/1940 | Tanis | |
| D189,997 | S | | 3/1961 | Shalom | |
| 3,682,298 | A | * | 8/1972 | Guillerm | 206/769 |
| 3,835,988 | A | * | 9/1974 | Buttery | 229/241 |
| 4,094,405 | A | | 6/1978 | Ruger | |
| 4,168,002 | A | | 9/1979 | Crosby | |
| D260,081 | S | | 8/1981 | Kronfeld | |
| 4,294,400 | A | * | 10/1981 | Gendron | 229/71 |
| D261,861 | S | | 11/1981 | Carter | |
| 4,354,631 | A | * | 10/1982 | Stevenson | 229/71 |
| D290,582 | S | | 6/1987 | Angerman | |
| D294,124 | S | | 2/1988 | Angerman | |
| 4,730,768 | A | * | 3/1988 | Gendron | 229/73 |
| 4,890,761 | A | | 1/1990 | Gaves | |
| 5,158,809 | A | | 10/1992 | Proctor | |
| 5,364,333 | A | * | 11/1994 | Gulliver et al. | 493/84 |
| 5,611,426 | A | * | 3/1997 | Warfield | 206/308.1 |
| D380,964 | S | * | 7/1997 | Miller et al. | D9/415 |
| 5,894,986 | A | * | 4/1999 | Lederman et al. | 229/71 |
| 5,927,592 | A | * | 7/1999 | Kranz | 229/71 |

* cited by examiner

*Primary Examiner*—Shian Luong
(74) *Attorney, Agent, or Firm*—Frank H. Foster; Kremblas, Foster, Phillips & Pollick

(57) ABSTRACT

A seed envelope includes an aperture covered by a transparent sheet. The aperture is particularly spaced from the bottom and two sides of the envelope. The aperture allows the purchaser to view the seeds which fill at least a portion of the seed envelope. In order to incorporate the transparent sheet, the envelope must be filled from the top, away from the transparent sheet and aperture.

5 Claims, 3 Drawing Sheets

SEED ENVELOPE AND METHOD OF PACKAGING SEED

BACKGROUND OF THE INVENTION

1. Field of the Invention

The present invention relates to seed envelopes, most particularly to new seed envelopes which include an aperture covered by a transparent sheet.

2. Description of the Related Art

In the past, people have used boxes or envelopes with windows in them to display a variety of products. Many of the windows have covered substantially all of the box. These patents include U.S. Pat. Nos. D.47,228; D.87,489; D.94,588; D.123,512; D.189,997; and D.294,124. Others have used smaller windows in a variety of locations covering a variety of portions of the container. These include U.S. Pat. Nos. D.260,081; D.261,861; D.290,582; and 4,890,761. However, these various designs are unsuitable for use in creating a seed envelope to package seeds. The seed envelope is in general smaller than many of the prior art designs which would not be suitable for viewing seed.

Some patents have discussed the packaging of seeds and bulbs. These include U.S. Pat. Nos. 4,094,405; 4,168,002; and 5,158,809. However, the only one of these patents which shows the use of the seed package for allowing a person to view the seed is U.S. Pat. No. 4,168,002. This patent shows a blister pack which allows a user to see multiple types of seeds in a package. However, for the majority of seeds that are sold, such a design is not necessary. The purpose of the particular design shown in the '002 patent is to enable a user to cut open the bottom of the blister pack to allow easy distribution of the seeds and also to allow someone to see the seeds. However, the seeds which are placed in the blister packs are coated with a material which will cause each seed to be a different color such that it is easier for a user to use the seeds. For most applications, this is unnecessary and unwanted.

It is standard in the industry to have a seed envelope which has printing on it. The printing is often a picture of a fully-grown plant which has been grown from the seed that is within the envelope. The printing defines the top and the bottom of the seed envelope. The industry standard is to seal the envelope by folding a sheet and sealing the top and the side of the envelope. The bottom is left open and the seeds are inserted into the envelope through the bottom in order to leave the top with a better, cleaner seal for the customer to open. Such practices are not practical if one desires to use an aperture in the envelope with a transparent sheet in front of it for viewing seed displayed in a display rack because this conventional practice would damage or destroy the transparent sheet.

While it is desirable to have a seed packet which allows a user to see the seeds, the structures shown in the prior art patents are unsuitable. What is needed is a simplified envelope of a size and shape similar to typical seed envelopes which customers are accustomed to but which also allows a user to see the seed that he or she is getting prior to purchasing or opening the seed envelope. The envelope should be about the size of the standard seed envelope, i.e. about 8 cm by 12 cm. This size is necessary in order for the envelope to fit on the standard seed envelope rack. In addition, the window in the seed envelope must be placed in a position on the face of the envelope and be of such a size as to allow a potential purchaser to see the seed within the seed envelope while still having sufficient structural stability to withstand the filling procedure.

SUMMARY OF THE INVENTION

Because it was discovered that purchasers desired to see the seed they were purchasing prior to purchase, structural changes were needed in the envelope.

Ideally, the seed envelope is made of a folded sheet. Folding the sheet defines the front face and the back face of the envelope. The front face includes an aperture which is covered by a transparent sheet. The aperture is closer to the bottom of the envelope than the top of the envelope. A first side and a second side of the envelope extend from the top to the bottom opposite each other. The aperture is spaced between about ½ cm and 2 cm from the bottom and between about ½ cm and 8 cm from each of the two sides. A seed envelope should be of the standard size, its height being the measure of distance between the top and the bottom and is between about 9 cm and 15 cm. The width of the envelope is the distance between its first side and second side and is between about 6 cm and about 10 cm. In any case the distance from the first side to the second side should always be less than the distance between the top and the bottom.

The transparent sheet is critical in that it must be strong enough to withstand battering or puncture by the seeds which fill the seed envelope. The tensile strength of the transparent sheet must be great enough to withstand puncture. The thickness of the transparent sheet should be about ½ mils. It is important that the envelope as a whole be strong enough to withstand the insertion of the seed. If a seed envelope including an aperture and transparent sheet is filled from the bottom, i.e., nearer the aperture and transparent sheet, the transparent sheet will rupture and spill seed during filling. Thus, the envelope should be filled from the top rather than the standard bottom filling.

The seed envelope need not be filled the entire way with seeds and as a rule seed envelopes are not filled entirely with seeds. Instead, the seed envelope should be filled with seeds such that the seeds are visible through the transparent sheet and aperture.

Figure 1:
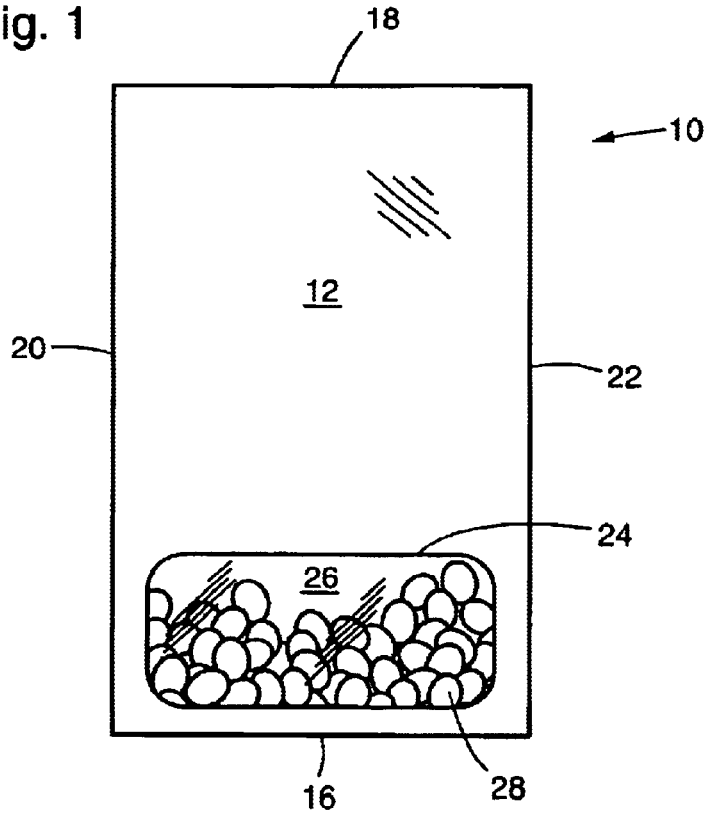
FIG. 1 is a front view of the fully assembled seed envelope in accordance with the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DESCRIPTION OF THE PREFERRED EMBODIMENTS

Figure 2:
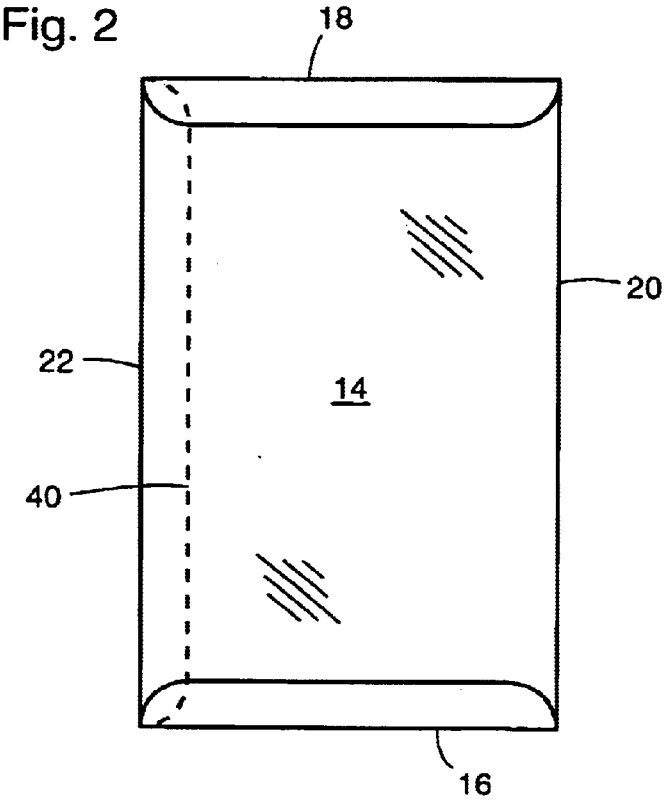
FIG. 2 is a back view of the fully assembled seed envelope according to the invention.

Turning first to FIGS. 1 and 2, a seed envelope 10 is shown in assembled form. The seed envelope 10 includes a front face 12, a back face 14, a bottom or bottom edge 16 and a top or top edge 18. The first side 20 or first side edge 20 and the second or second side edge 22 extend opposite each other from the top 18 to the bottom 16. The front face 12 includes an aperture 24. The aperture 24 is covered by a transparent sheet 26. The fully assembled seed envelope 10 is filled at least partially with seeds 28.

Figure 3:
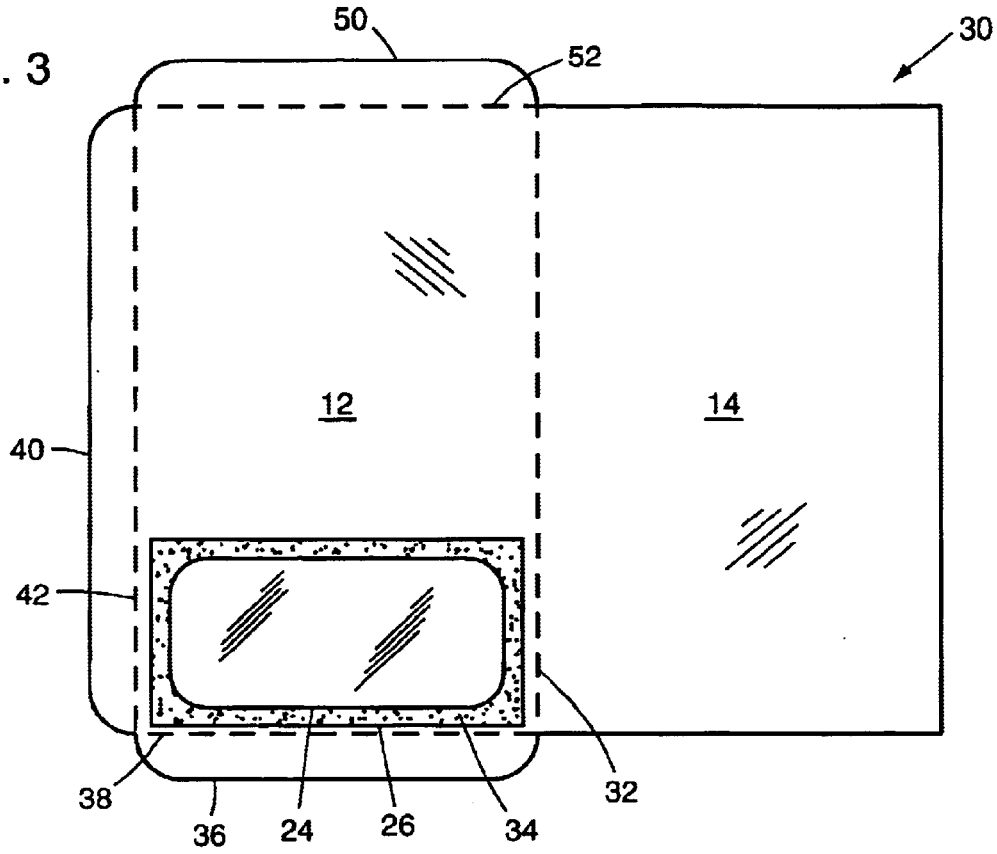
FIG. 3 is a back view of the seed envelope prior to assembly.

Turning now to FIG. 3, a sheet 30 is shown. The sheet 30, when fully assembled, becomes the seed envelope 10. A first fold line 32 is shown as a dashed line which separates the front face 12 from the back face 14. The preferred method for attaching the transparent sheet 26 to the front face 12 covering the aperture 24 is shown. An adhesive 34 is applied around the periphery of the aperture 24. The transparent sheet 26 is then attached to the front face 12 by pressing the transparent sheet 26 against the adhesive 34. Any known method of attaching the transparent sheet 26 to the front face 12 may be used depending on the precise materials selected for the sheet 30 and the transparent sheet 26.

Figure 4:
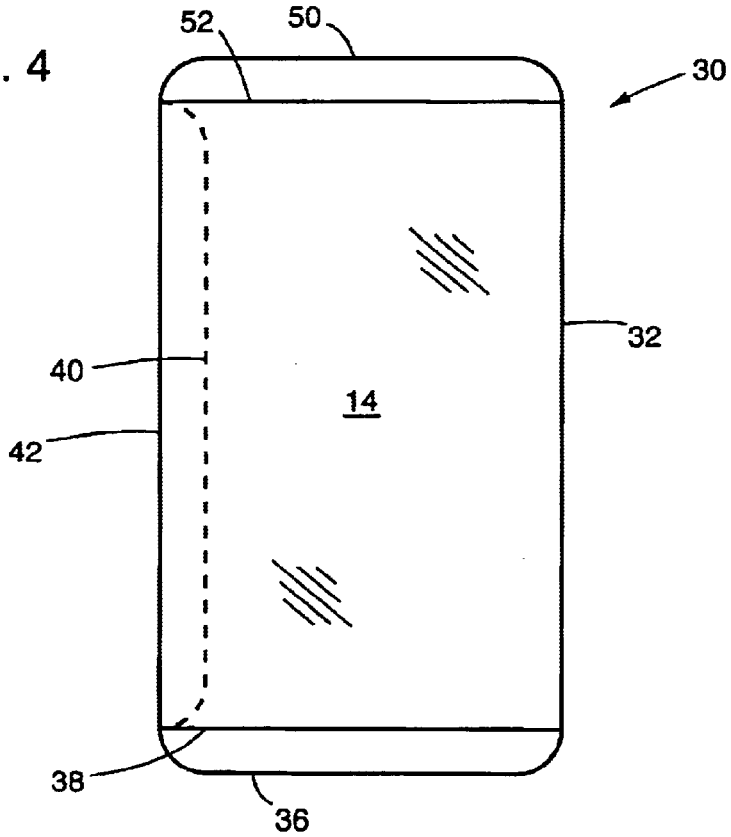
FIG. 4 is a back view of the folded seed envelope according to the invention.
Figure 5:
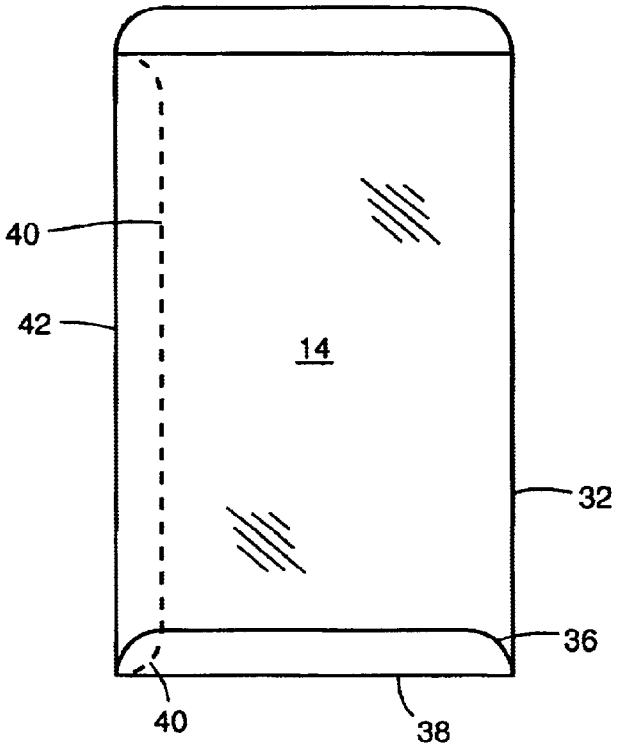
FIG. 5 is a back view of the seed envelope with flaps sealed against the back face.

The first flap 40 is folded along a first fold line 42. An adhesive is then applied to the first flap 40. The back face 14 is then folded along a second fold line 32 to contact the first flap 40. The now folded sheet 30 then appears as shown in FIG. 4 (the first flap 40 being shown by dashed lines). An adhesive is then applied to the second flap 36 which is folded along a third fold line 38 to come in contact with the back face 14. The folded sheet 30 then appears as shown in FIG. 5.

Figure 6:
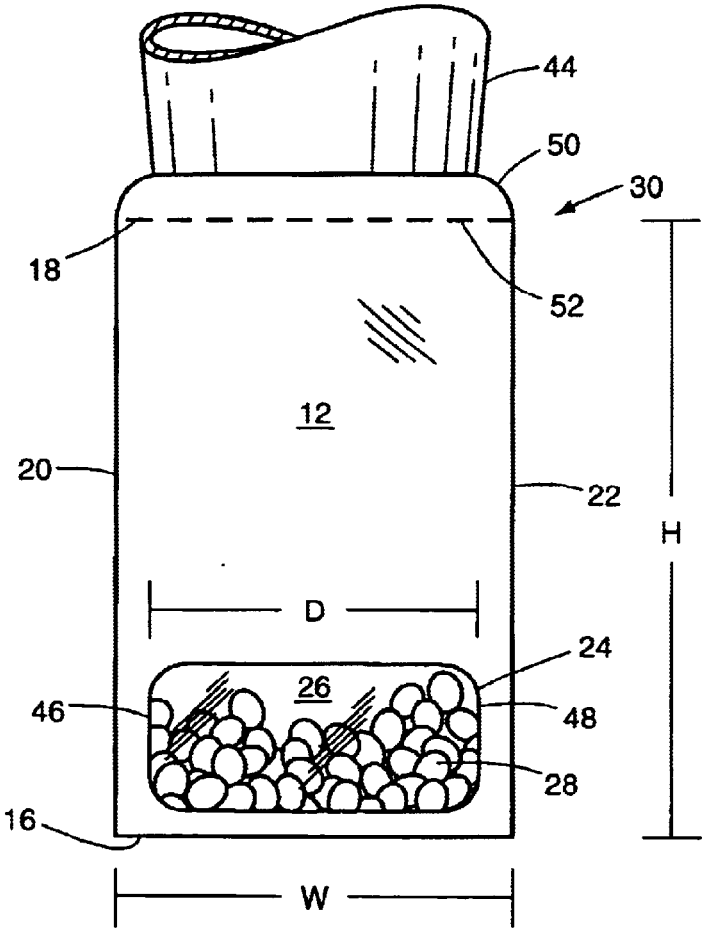
FIG. 6 is a front view of the assembled seed envelope according to the invention including the insertion of the packet entry funnel and filling of the seed envelope with seeds.

A conventional packet entry funnel 44 is then inserted into the top end 18 of the folded sheet 30, as shown in FIG. 6. The packet entry funnel 44 may be any of a variety of spouts, spigots or the like which are attached to conventional seed envelope filling machines (not shown).

A number of considerations are important when packaging seeds 28 in the seed envelope 10. A first concern is the ability of the envelope and the transparent sheet 26 to hold the seeds 28 without rupturing or puncturing. The aperture 24 must be positioned such that it will allow the seeds 28 to be seen by a purchaser. However, limitations of the seed filling machines must also be taken into consideration when determining the appropriate location of the aperture 24. The aperture 24 must be at least ½ cm from each of the bottom 16, the first side 20 and the second side 22. If the aperture 24 is any closer to the bottom 16, the strength of the envelope will be insufficient and the envelope crushes during filling. In addition, the packet entry funnel 44 must be inserted into the folded sheet 30. It is thus critical that the packet entry funnel 44 be inserted into the top 18. If the packet entry funnel 44 inserted into the bottom 16, the packet entry funnel 44 is likely to tear or scrape the transparent sheet 26, thereby weakening or rupturing the transparent sheet 26, rendering the envelope 10 incapable of holding the seeds 28. The envelope must therefore be filled in the top 18, away from transparent sheet 26.

Similarly, a number of conventional seed filling machines require that extensions (not shown) be inserted along first side 20 and second side 22 of seed envelope 10, in order to stabilize envelope 10 during filling, thereby requiring that the aperture 24 be at least ½ cm from each side 20,22. The spacing of the aperture 24 this far from the sides 20,22 of the envelope 10 is to prevent the extensions coming into contact with and rupturing transparent sheet 26. In addition, the space between aperture 24 and any of the sides or bottom must be sufficiently great to allow the adhesive 34 to be placed on the front face 12. Thus, the aperture 24 must be spaced at least ½ cm from each of first side 20, second side 22 and bottom 16. It will be appreciated that the term "spaced from" indicates that at its closest point, the aperture 24 must not be any closer than the distance noted.

It is also important that the aperture 24 be placed sufficiently near the bottom 16 that the seeds 28 which are placed in the seed envelope 10 are visible to a purchaser when the bottom 16 is supported on a display rack below the top. If the aperture 24 is too high, an undue amount of seed 28 is required in order to enable a purchaser to view the seed 28. Thus, the aperture 24 must be spaced no more than 2 cm from bottom 16. While the aperture 24 can extend a greater distance above the bottom 16, the closest point of the aperture 24 must be no more than 2 cm from bottom 16. In addition, the aperture 24 should not extend too close to the top 18, because the envelope 10 is likely to be crushed or the transparent sheet 26 is likely to rupture. Thus, the aperture 24 will always be closer to the bottom 16 than the top 18.

Similar structural requirements are not as critical when determining the distance of the aperture 24 from the first side 20 and the second side 22. It is important that the aperture 24 be large enough to allow a purchaser to see the seed. The minimum distance D from the first side 46 of the aperture 24 to the second side 48 of the aperture 24 is about 1 cm. If the distance D is less than 1 cm, it is too difficult for a purchaser to see the seeds. While the aperture 24 is shown in the FIGS. as extending much of the way across front face 12, aperture 24 need not be so sized or shaped in a rectangular manner. Instead the distance the aperture 24 is spaced from the first side 20 or the second side 22 is governed only by the size of the envelope 10. The envelope 10 has a width W between the first side 20 and the second side 22 of between about 6 cm and about 10 cm. Because the aperture 24 has to have a distance D of at least 1 cm and because the aperture 24 must be at least ½ cm from the first side 20 and the second side 22, the aperture 24 must be spaced between about ½ cm and about 8 cm from each of the first side 20 and the second side 22. It is noted also that envelope 10 has a height H between bottom 16 and top 18. The height H is typically between about 9 cm and about 15 cm. Preferably the envelope width W is about 8 cm and the height H is about 12 cm. Also preferably the distance D is about 80% of the width W.

Apart from the size of the envelope, the tensile strength and thickness of the transparent sheet 26 are also important. The tensile strength of the transparent sheet 26 must be great enough to prevent its puncture by seeds 28 placed in the envelope 10 by the packet entry funnel 44. The required tensile strength varies based on the type of seeds 28 being placed in seed envelope 10, most particularly based on the size and shape and weight of the seeds 28. The transparent sheet 26 typically has sufficient tensile strength to retain the seeds 28 if it has a thickness of at least ½ mil. The transparent sheet 26 is preferably made from polypropylene.

At least a portion of the seed envelope 10 is filled with seeds 28 through the packet entry funnel 44. Sufficient seeds 28 should be put in the seed envelope 10 to enable a purchaser to see seeds 28 through the aperture 24 and the transparent sheet 26. After the seed envelope 10 has been at least partially filled with seeds 28 such that a purchaser can see the seeds 28 through the aperture 24 and the transparent sheet 26, the packet entry funnel 44 is removed from the top end 18 of the folded sheet 30. An adhesive is then placed on the third flap 50, which is folded along the fourth fold line 52 to contact the back face 14. The packaging of the seed 28 is then complete and the seed envelope 10 has the completed form as shown in FIGS. 1 and 2.

In all of the above descriptions of the sealing of the flaps to back face 14, the standard or conventional adhesive and sealing methods may be used.

What is claimed is:

1. A seed envelope comprising:

(a) a folded sheet having a front face including an aperture, a back face, a bottom edge, a top edge, a first side edge and a second side edge extending opposite each other from said top edge to said bottom edge, height and width dimensions of a seed envelope being a height from said top edge to said bottom edge between about 9 cm and about 15 cm, and a width from said first side edge to said second side edge between about 6 cm and about 10 cm, said height being greater than said width, said aperture being closer to said bottom edge than to said top edge; said aperture being spaced between about ½ cm and about 2 cm from said bottom edge, and at least ½ cm from each of said side edges, the aperture having a width of at least 1 cm, whereby a desired quantity of seeds placed within the seed envelope is seen through the aperture when the seed envelope rests on its bottom edge while retaining sufficient structural stability to permit the insertion of the seeds without being destroyed; and (b) a transparent sheet attached to said front face covering said aperture.

2. The seed envelope according to claim 1, wherein said transparent sheet is attached to said front face by an adhesive.

3. The seed envelope according to claim 1, wherein said aperture has a first side and a second side, the distance from said first side of said aperture to said second side of said aperture is less than 80% of the width of said seed envelope.

4. The seed envelope according to claim 1, wherein said transparent sheet has a thickness of about ½ mils.

5. A seed envelope comprising:

(a) a folded sheet having a front face including an aperture, a back face, a bottom edge, a top edge, a first side edge and a second side edge extending opposite each other from said top edge to said bottom edge, said aperture being closer to said bottom edge than to said top edge; said aperture being spaced between about ½ cm and about 2 cm from said bottom edge, and at least ½ cm from each of said first side edge and said second side edge, the aperture and the envelope each having a width, the width of the aperture being about 80% of the width of the envelope; and (b) a transparent sheet attached to said front face covering said aperture.

* * * * *